United States Patent [19]

Cooper

[11] 4,165,001

[45] Aug. 21, 1979

[54] BONDED STACKED SNAP RINGS

[76] Inventor: Thomas F. Cooper, 2203 Airport Rd., Opelika, Ala. 36801

[21] Appl. No.: 923,319

[22] Filed: Jul. 10, 1978

[51] Int. Cl.[2] ..... B65D 85/24

[52] U.S. Cl. ..... 206/343; 221/93; 29/413

[58] Field of Search ..... 206/340, 343; 29/413, 29/229; 221/93

[56] References Cited

U.S. PATENT DOCUMENTS

| | | | |
|---|---|---|---|
| 2,222,726 | 11/1940 | Sorenson | 206/343 |
| 3,623,635 | 11/1971 | Erdmann | 221/93 |
| 3,846,900 | 11/1974 | Weglage | 29/413 |
| 4,043,452 | 8/1977 | Ross | 206/343 |

*Primary Examiner*—George T. Hall

*Attorney, Agent, or Firm*—Clarence A. O'Brien; Harvey B. Jacobson

[57] ABSTRACT

A stacked plurality of snap rings adhesibly retained by varnish coating, or other bonding method applied to the rings. Internal or external circular or C-shaped snap rings typically have retainer ring holes and in this invention the holes in adjacent rings in the stack are misaligned. Snap ring pliers or automated equipment can be inserted into the retainer ring holes of the endmost snap ring fastened at the top of the stack, with the tips of the pins penetrating only through the holes in the topmost ring, due to their misalignment, with the topmost ring being removed by movement of the pins relative to each other, thereby facilitating efficient dispensing of one snap ring at a time.

11 Claims, 5 Drawing Figures

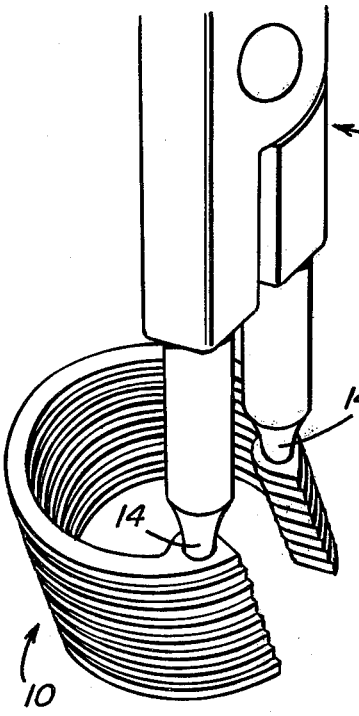
Fig. 1
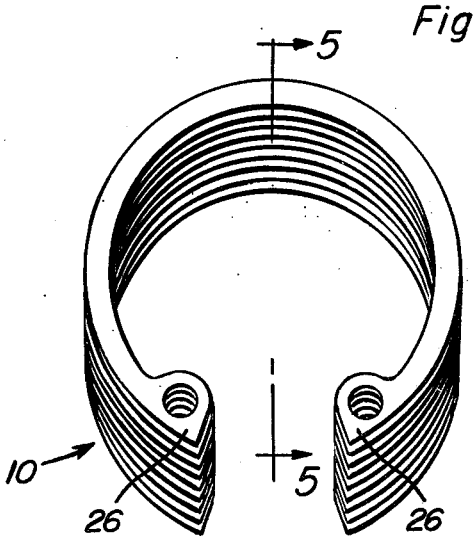
Fig. 3
Fig. 4
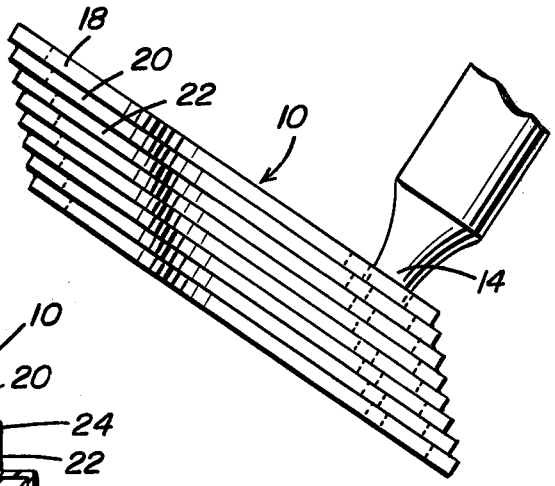
Fig. 2
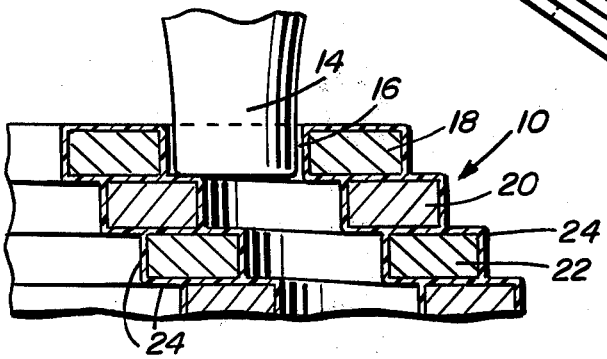
Fig. 5
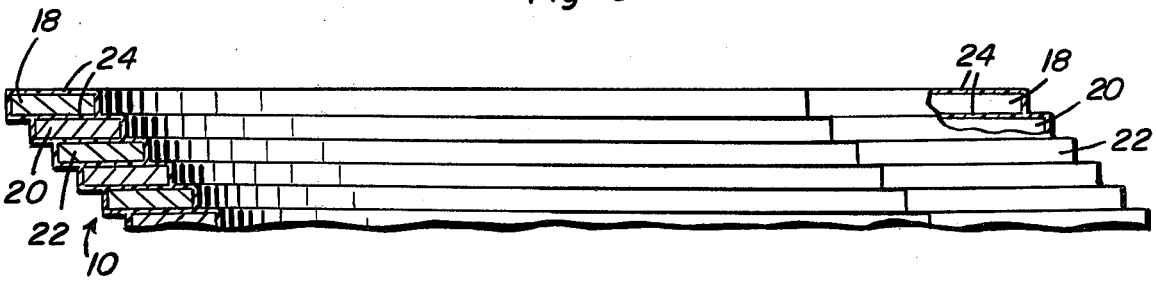

BONDED STACKED SNAP RINGS

BACKGROUND OF THE INVENTION

1. Field of the Invention

The invention relates to packaging of retaining rings for use in assembly processes. More particularly, the invention relates to releasably joining snap rings in stacked configuration for easy separation and dispensing of individual rings.

2. Description of the Prior Art

Prior methods of storage of snap rings have not provided snap rings which are bonded together for storage and individual dispensing in the manner of the present invention. Wire stacked rings have been arranged with a wire passing through retainer ring holes for compactness in shipping, and loose boxed and assorted sizes of retainer rings are commonly shipped and stored in a box or bin. When mixed together, the rings have been found to become tangled together, requiring considerable effort and time to separate each snap ring as needed. The result has been a bottleneck in assembly processes in which snap rings are utilized for production of machinery or other articles.

Use of deformable C-shaped rings (hog nose rings) bonded together has been disclosed, such as in U.S. Pat. No. 3,506,116, issued Apr. 14, 1970, to Winters, and in U.S. Pat. No. 2,222,726, issued Nov. 26, 1940, to Sorenson. Winters shows an insulated C-shaped ring in the form of a plurality of parallel members interconnected by means of a thin plastic web, each having an inner wire core and an extruded plastic covering. The assembly is placed over wires to be bound together and a hand tool deforms successive rings about the wires. Sorenson provides a staple clip tool for first separating the leading staple from a clip of obliquely arranged staples and then forcing the staple through a driver channel and driving the staple into material to be stapled. In both cases described by these two patents, the remaining rings are retained either upon the tool or upon the work being encased. Consequently, it is not convenient to dispense a single ring quickly and easily as needed.

Also known are staples stacked in oblique fashion, as described in U.S. Pat. No. 3,373,646, issued Mar. 19, 1968, to Ehlert. Ehlert provides a staple with a planar head portion, with the staples adhering together by their legs or head portions, with insertion in the article to be stapled by a suitable staple gun, or the like. The difficulty associated with the staples of the Ehlert configuration resides in the necessity for having a flat cross bar portion for insertion of the flat planar head, as well as the absence of retainer ring holes which contribute to the utility of the snap rings of the present invention.

Dispensing devices for circular shaped snap rings are shown by Erdmann in U.S. Pat. No. 3,623,635, issued Nov. 30, 1971; by Weglage in U.S. Pat. No. 3,846,900, issued Nov. 12, 1974; and by Ross in U.S. Pat. No. 4,043,452, issued Aug. 23, 1977. Erdmann shows a dispenser for retaining rings having retainer ring holes where a column of rings is maintained upon a magazine rail, raised to an offset position, and dispensed by conventional pliers-type ring pick off tool inserted into the retainer ring holes. Use of such a dispenser requires construction of a special dispenser with moving parts requiring periodic loading of retaining rings, and is not conveniently accessible wherever needed in a manufacturing process, such as on an assembly line. The C-shaped ring holder of Ross permits storage on an article for application of a plurality of such rings in forming an electrical connector. Weglage shows a dispenser for furnishing rings arranged in the form of a band or strip and individually separated as the end of the strip is fed from the dispenser. None of these three dispensing devices offers easy transportability and maintenance free operation which conditions are important for use of snap rings in manufacturing operations, such as for use in an assembly line process.

SUMMARY OF THE INVENTION

The present invention overcomes difficulties associated with prior methods of storing or dispensing of circular retainer rings by providing a stack of adhered rings which facilitates easy removal of a single ring with use of conventional snap ring pliers or automatic machines. Retainer rings are stacked with the holes offset, permitting the tip of the pliers or machine to penetrate into only the retainer ring holes of the endmost ring of the stack. An appropriate motion of the pliers or machine causes this ring to break off from the stack in position for use. Rings are bonded lightly together by application of a varnish or other suitable material about the outside surfaces of the rings before assembly into the stack. Also, the rings may be held in a stack by magnetic attraction, etc. A stack of rings is conveniently grasped manually, or alternatively, the stack can be placed upon a flat surface, or other retaining means, such as a pin, rail or peg.

Accordingly, it is an object of the present invention to provide an arrangement of snap rings for storage and for convenient and efficient dispensing of a single ring as needed.

Another object of the invention is to provide an obliquely stacked adhering column of split spring retainer rings having retainer ring holes which are misaligned so as to permit insertion of conventional pick up pins or tips through retainer ring holes of the endmost ring only, with dispensing of the endmost ring accomplished in a single movement of the pins or tips.

A further object of the invention is to provide an arrangement of stacked retainer rings adapted for removal of a single ring from a stack held in the hand, placed upon a flat surface, or otherwise held in place.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a stack of snap rings according to the present invention illustrating the manner in which snap ring pliers are used to remove the endmost ring.

FIG. 2 is an enlarged, fragmental, sectional view showing details of an inserted tip of the pliers into the retainer ring holes of the endmost ring of the stack.

FIG. 3 is a top plan view of the snap ring stack of one form of the present invention.

FIG. 4 is a side elevational view of the snap ring stack of one form of the present invention in a tilted position, such as when held in the palm of the hand, showing inserted snap ring pliers.

FIG. 5 is an enlarged, transverse, sectional view taken substantially upon a plane passing along section line 5—5 of FIG. 3, partly broken away to show the coating, and showing the uppermost rings of the stack of the present invention.

DESCRIPTION OF THE PREFERRED EMBODIMENTS

The stack of rings either internal or external of the present invention is designated generally by the numeral 10 in FIGS. 1 to 5, and the numeral 12 designates generally conventional snap ring pliers adapted for use with the snap rings of the present invention. Pliers 12 have tips 14 for insertion in retainer ring holes 16 of individual retainer rings 18, 20, 22, and the like to enable the free ends of the ring to be moved towards or away from each other by pivoting the tips 14 of the pliers 12 in a well-known manner. Coating 24, such as varnish, or the like, is applied to the rings before stacking and causes individual rings 18, 20 and 22, and the like, to adhere, and can be a varnish or other suitable coating material applied to rings 18, 20, 22, and the like, by a suitable applicator, by spraying, or by other appropriate conventional techniques.

Snap ring pliers 12 perform the conventional function of holding and applying a snap ring by engaging retaining ring holes 16 located near ears 26. Snap rings 18, 20, 22, and the like, are arranged obliquely or offset, as is best illustrated in FIGS. 2 and 4, in order to permit insertion of tips 14 of pliers 12 into retaining ring holes 16 only to the depth of the endmost snap ring 18. Contact of tips 14 with underlying offset ring 20 prevents further insertion of pliers 12. In such a position, as illustrated in FIG. 2, endmost snap ring 18 is easily detached from rings remaining on stack 10 by a suitable opening or closing motion of pliers 12. Ring 18 is then held on tips 14 of pliers 12 and is ready for application as needed. The degree of misalignment of the retainer rings comprising stack 10 is chosen to permit tip 14 of pliers 12 to penetrate only to the depth of the endmost snap ring 18, as shown in FIG. 2, before contacting adjacent snap ring 20 which prevents further penetration. Accordingly, the misaligned relation of the rings can fall within a wide range, subject only to the requirement that pliers 12 remove only one snap ring at a time from stack 10.

Illustrated in the drawings are internal retainer rings for reception in internal grooves. The present invention, however, is equally applicable and operable for external retainer rings.

In an alternative embodiment, retaining rings of circular shape and having retainer ring holes near the ears are stacked flush, but with adjacent rings rotated slightly in a regular or random pattern so as to provide the offset or misalignment of adjacent retainer ring holes. This produces a cylindrical stack with ears tracing the outline of a spiral when rotated in a regular pattern, but with adjacent rings flush. Consequently, removal of a ring from such a stack would proceed in the same manner as for an oblique stack, subject to the same condition that tips 14 of pliers 12 remove only one endmost ring at a time. The preferred mode of carrying out the present invention, however, is the oblique stacked arrangement shown in FIGS. 1 to 5 since it facilitates the positioning of the stack in the palm portion of one hand while the pliers are conveniently held and manipulated in the other hand.

The present invention also contemplates the rings being held in a stack by other means such as by using magnetism with each ring being slightly magnetized or subject to an electrostatic charge. Also, the stack of rings is well adapted for use with various automatic applicators such as used in assembly lines and the like. Various bonding agents, such as paraffin, hardenable grease-like substances and the like may be used. Also, the rings may be bonded together by various mechanical means such as a suitable clip.

The present invention provides a simple and inexpensive solution to the problem of dispensing snap rings for individual use efficiently and economically. Disadvantages associated with push pin ejector, roll tape, and shaker type devices are avoided, such devices being costly, sometimes inordinately complex, occasionally quite bulky, and offering little reliability or failing to function as intended.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An arrangement of a plurality of split retainer rings, adapted to be operated by a ring-withdrawing and assembling tool having tips, comprising a stack of said rings bonded together, each of said rings having retainer ring holes offset from retainer ring holes in adjacent rings comprising said stack whereby the tips can be inserted into the holes in only the endmost ring.

2. The arrangement of claim 1 wherein said offset retainer ring holes result from oblique stacking of said retainer rings such that an endmost retainer ring is removable from said stack by said tips insertable into said retainer ring holes of said endmost retainer ring.

3. The arrangement of claim 1 wherein said offset retainer ring holes result from flush stacking of said rings with rotational offset of adjacent rings such that a single ring is removable from said stack by said tips.

4. The arrangement of claim 1 wherein said rings are bonded together by a coating material on the outside of said rings.

5. The arrangement of claim 4 wherein said coating material is selected from the group including varnish, paraffin, hard grease, or other material, suitable to application to the snap ring.

6. The arrangement of claim 1 wherein said retainer rings are internal retainer snap rings.

7. The arrangement of claim 1 wherein said retainer rings are external retainer snap rings.

8. The arrangement of claim 1 wherein said rings are bonded together by magnetic force.

9. The arrangement of claim 1 wherein said rings are bonded together by mechanical means such as a suitable clip.

10. A method for use of a single retaining ring by a user of the arrangement of claim 1 comprising the following steps:

(a) placing said stack in the palm of the user's hand;
(b) inserting said tips with the user's opposite hand;
(c) detaching said endmost retainer ring by manual movement of said tips with respect to said stack; and (d) transporting said ring on said tips to a point of application.

11. A method of dispensing a snap ring by a user of the arrangement of claim 1 comprising the following steps:

(a) placing said stack on a flat surface;

(b) inserting said tips into said endmost retainer ring;

(c) detaching said endmost ring by manually moving said tips with respect to said stack; and (d) transporting said ring on said tips to a point of application.

* * * * *